US006460210B1

(12) United States Patent
Alpert

(10) Patent No.: US 6,460,210 B1
(45) Date of Patent: Oct. 8, 2002

(54) MULTI-PURPOSE HAMMER

(76) Inventor: Alexander G. Alpert, 37 Clifford St., Southborough, MA (US) 01772

( * ) Notice: Subject to any disclaimer, the term of this patent is extended or adjusted under 35 U.S.C. 154(b) by 0 days.

(21) Appl. No.: 09/708,366

(22) Filed: Nov. 8, 2000

(51) Int. Cl.[7] ..... B25D 1/04
(52) U.S. Cl. ..... 7/144; 81/20
(58) Field of Search ..... 81/177.1, 489, 81/20; 7/143, 144, 146, 147

(56) References Cited

U.S. PATENT DOCUMENTS

| | | | | |
|---|---|---|---|---|
| 359,998 | A | 3/1887 | Christman | |
| 3,821,824 | A | 7/1974 | Pilcher | |
| 4,729,271 | A | 3/1988 | Kenigson | |
| 5,588,343 | A | * 12/1996 | Rust et al. | 81/489 |
| 5,829,082 | A | * 11/1998 | Moreira | 81/489 X |

OTHER PUBLICATIONS

Stortz publication, pp. 20–21, 1994.
Untitled North American Boecker Publication, Raleigh, N.C., 2 pages, printed Jan. 1998.
The New England Slate Company–Slater's "T" Stake, 1 page.
GT Products, Inc. Publication entitled "Snow guards: made of malleable iron —hot galvanized," 1 page.
Ebay advertisement, 1887 Allegheny Slate Roofing Tool, 2 pages.
John Stortz Publication entitled "Quality Handtools Since 1853," 6 pages.
Cleasby Roofing Products Publication, 2 pages.
Stubai publication, 2 pages.
The SlateBook, by B. Stearns et al., 1998, 3 pages.
Prior Art Slate Hammer (figures 1A and 1B).
Prior Art Slate Hammer (figures 2A and 2B).
Prior Art Slate Hammer (figures 3A and 3B).
Prior Art Slate Hammer (figures 4A and 4B).
Prior Art Slate Hammer (figures 5A and 5B).

* cited by examiner

*Primary Examiner*—James G. Smith
(74) *Attorney, Agent, or Firm*—Fish & Richardson P.C.

(57) ABSTRACT

A hammer includes a body having opposed, non-parallel cutting edges, and a cross bar attached to the body having a substantially flat side arranged relative to the cutting edges to permit left and right handed cutting. The cross bar includes a hammer head defining a central axis positioned off-axis of a central axis of the cross bar. The cross bar has a claw and a pointed end. The hammer includes a handle attached to the body. The handle defines a central axis positioned off-axis of a central axis of the body. The body of the hammer includes a handle stem with splines for receiving the handle and limiting rotation of the handle relative to the body.

12 Claims, 8 Drawing Sheets

MULTI-PURPOSE HAMMER

BACKGROUND

Multi-purpose hammers for cutting, installing and removing slate roofing generally include a body stem with a cutting edge, and a cross bar with a claw, a hammer head, and a pointed end.

SUMMARY

According to the invention, a hammer includes a body having opposed, non-parallel cutting edges, and a cross bar attached to the body having a substantially flat side arranged relative to the cutting edges to permit left and right handed cutting.

Embodiments of this aspect of the invention may include one or more of the following features.

The body has a substantially flat side continuous with the cross bar substantially flat side. The cross bar includes a hammer head defining a central axis positioned off-axis of a central axis of the cross bar. The cross bar has a claw and a pointed end. The hammer includes a handle attached to the body. The handle defines a central axis positioned off-axis of a central axis of the body. The body of the hammer includes a handle stem with a spline for receiving the handle and limiting rotation of the handle relative to the body. The handle stem has three splines.

According to another aspect of the invention, a hammer has a body including a handle stem with a spline, and a handle received by the handle stem. The spline limits rotation of the handle relative to the body.

Embodiments of this aspect of the invention may include one or more of the following features.

The handle is leather. The handle stem includes three splines. The body has opposed, non-parallel cutting edges. The hammer has a cross bar attached to the body. The cross bar has a hammer head, a claw, and a pointed end.

Advantages of the invention include a single hammer that can be used for both right and left handed cutting of slate roofing.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
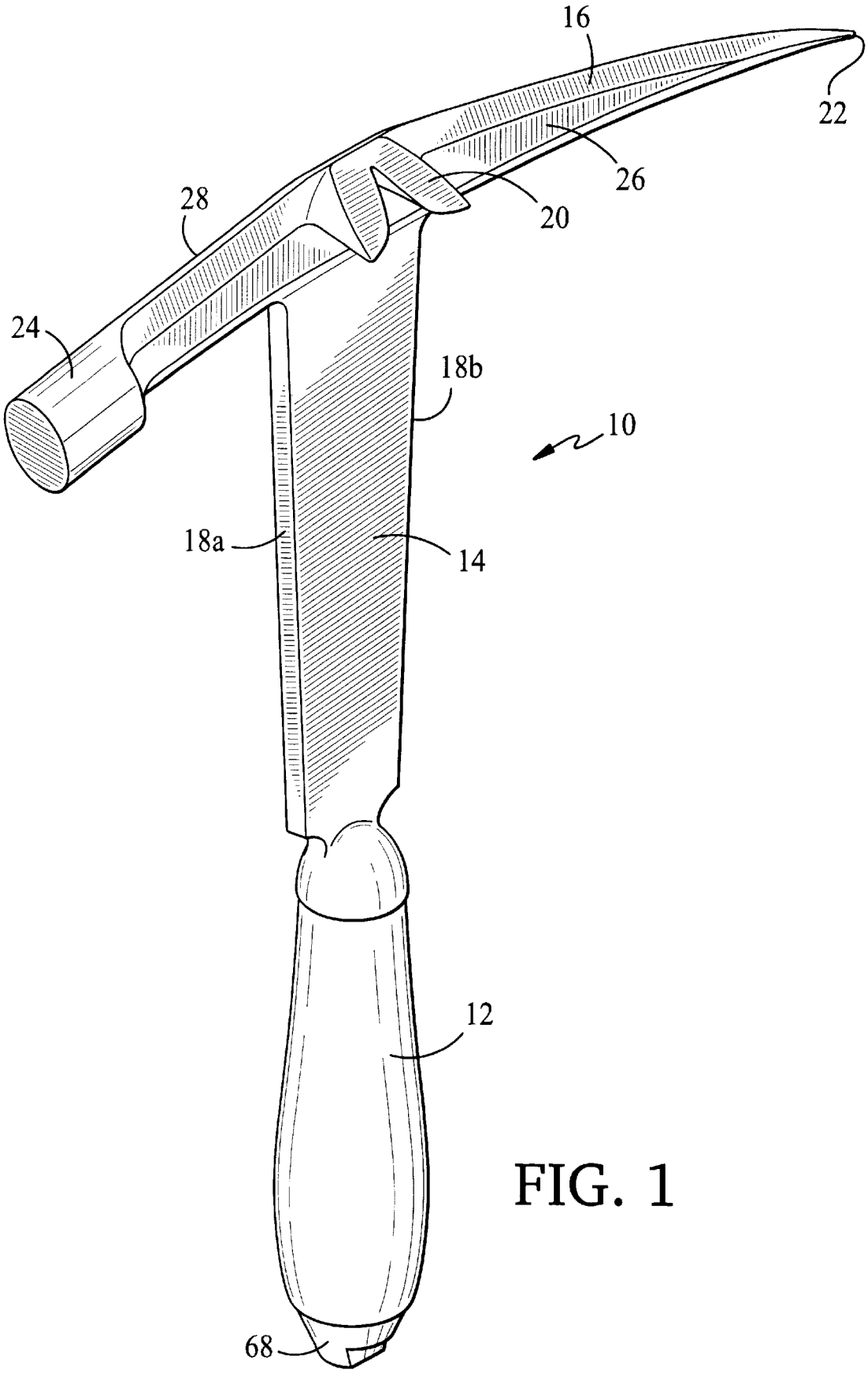
FIGS. 1 and 2 are perspective views of the hammer of the invention.
Figure 2:
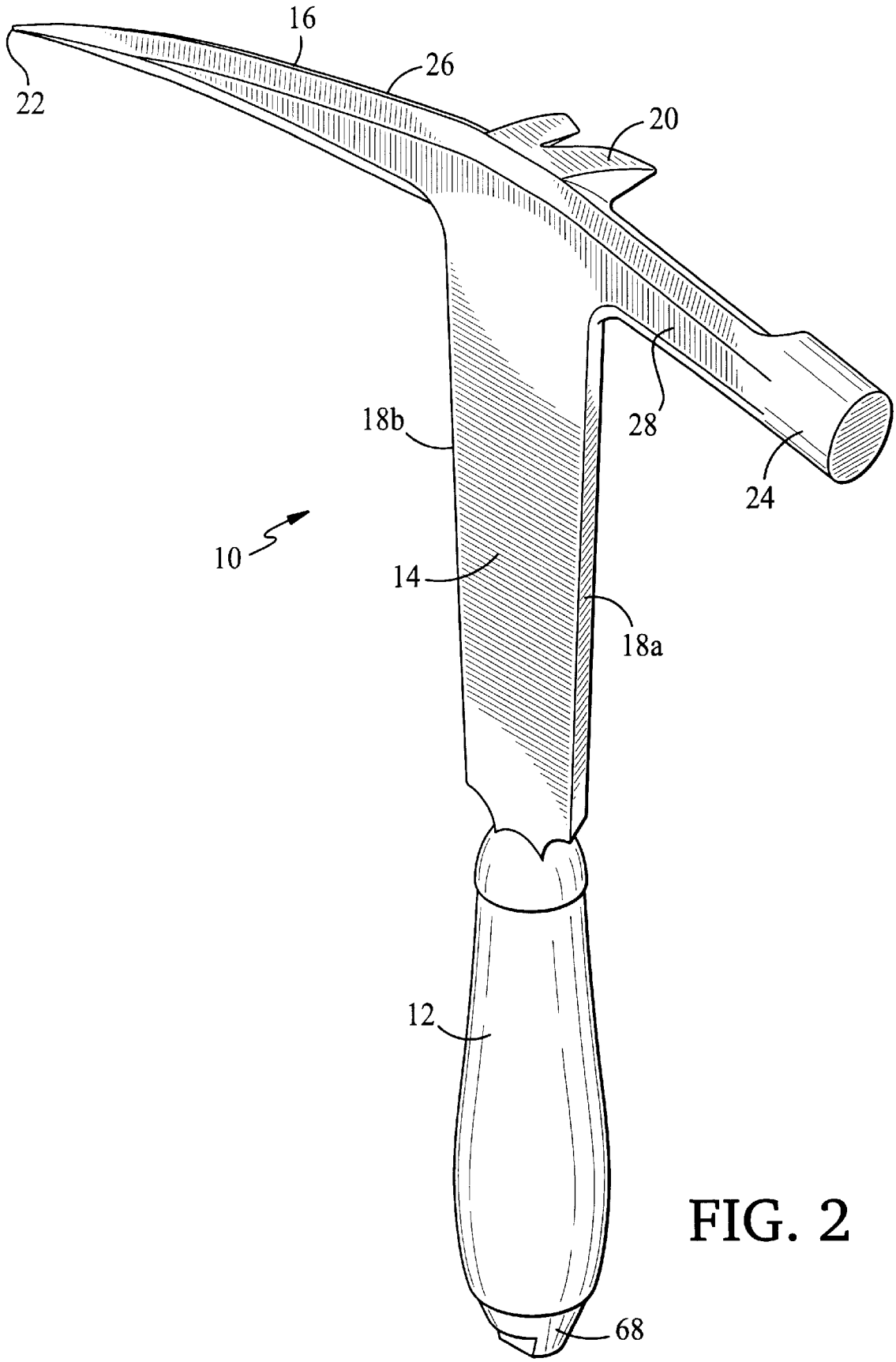

Referring to FIGS. 1–4, a multi-purpose hammer 10 includes a handle 12, a stem body 14, and a cross bar 16. Stem body 14 includes two opposed, non-parallel cutting edges 18*a* and 18*b* used, for example, to cut slate roofing. Cross bar 16 includes a claw 20 for removing nails, a point 22 for forming holes in the slate roofing, and a hammer head 24 for inserting nails. Cross bar 16 has a first side 26 and a second, opposite substantially flat side 28. Flat side 28 is arranged relative to cutting edges 18*a*, 18*b* to permit left and right handed cutting of slate roofing, as described below.

Figure 3:
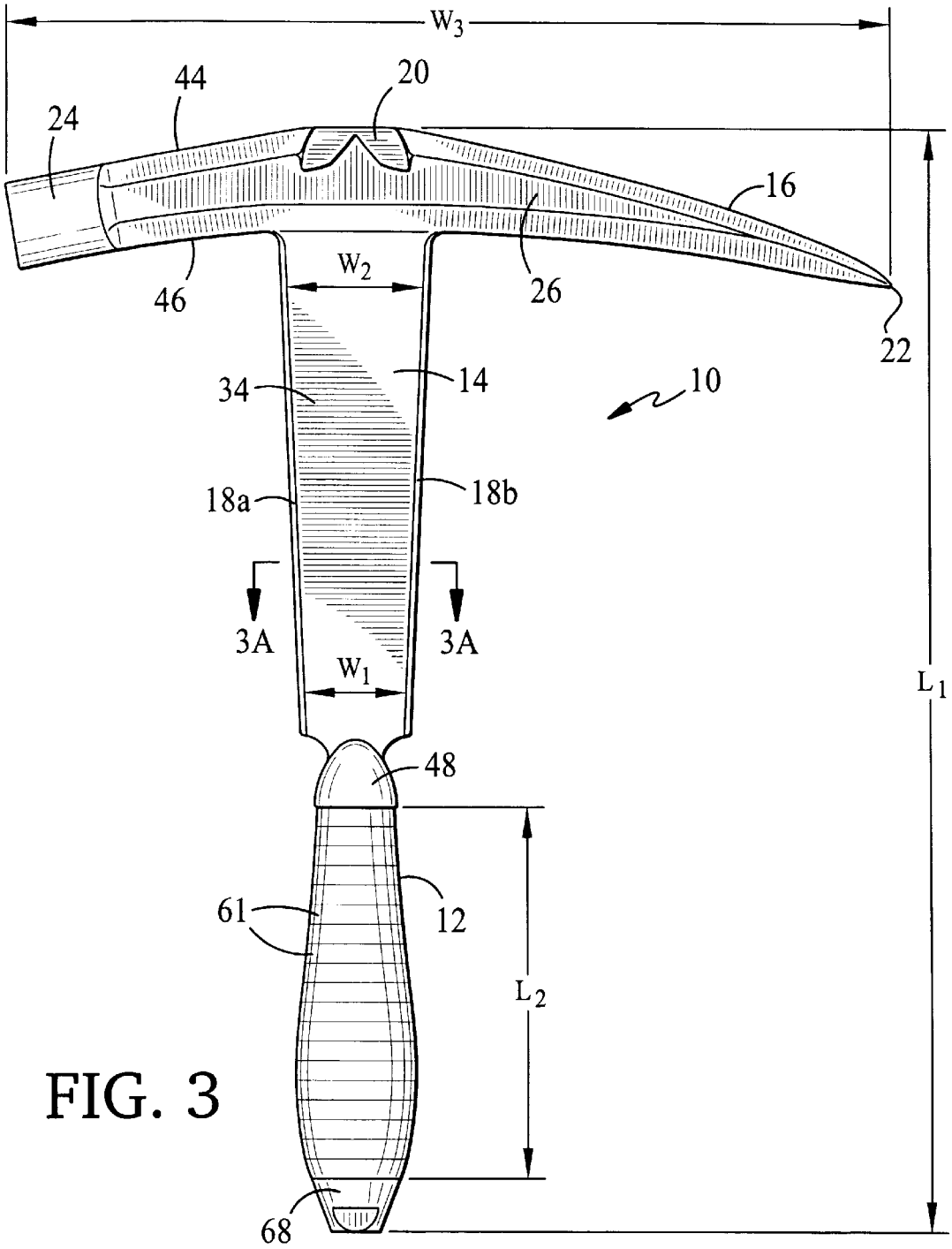
FIG. 3 is a front view of the hammer.
Figure 3A:
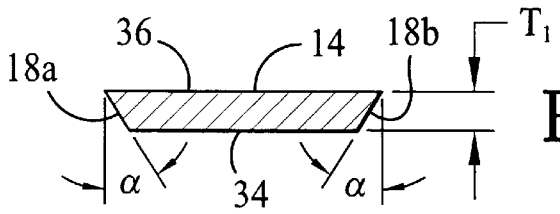
FIG. 3A is a cross-sectional view of a stem body of the hammer.

Referring particularly to FIG. 3A, cutting edges 18*a*, 18*b* extend from a first side 34 of stem body 14 to a second, longer side 36 of stem body 14 parallel to side 34. Edges 18*a*, 18*b* are oppositely oriented relative to sides 34, 36, and each edge is beveled at an angle, of about 10 degrees. Stem body 14 has a thickness, $T_1$, of about 5/16 inch, and tapers from a width, $W_1$, of about 1 inch to a width, $W_2$ of about 1½ inch.

Figure 4:
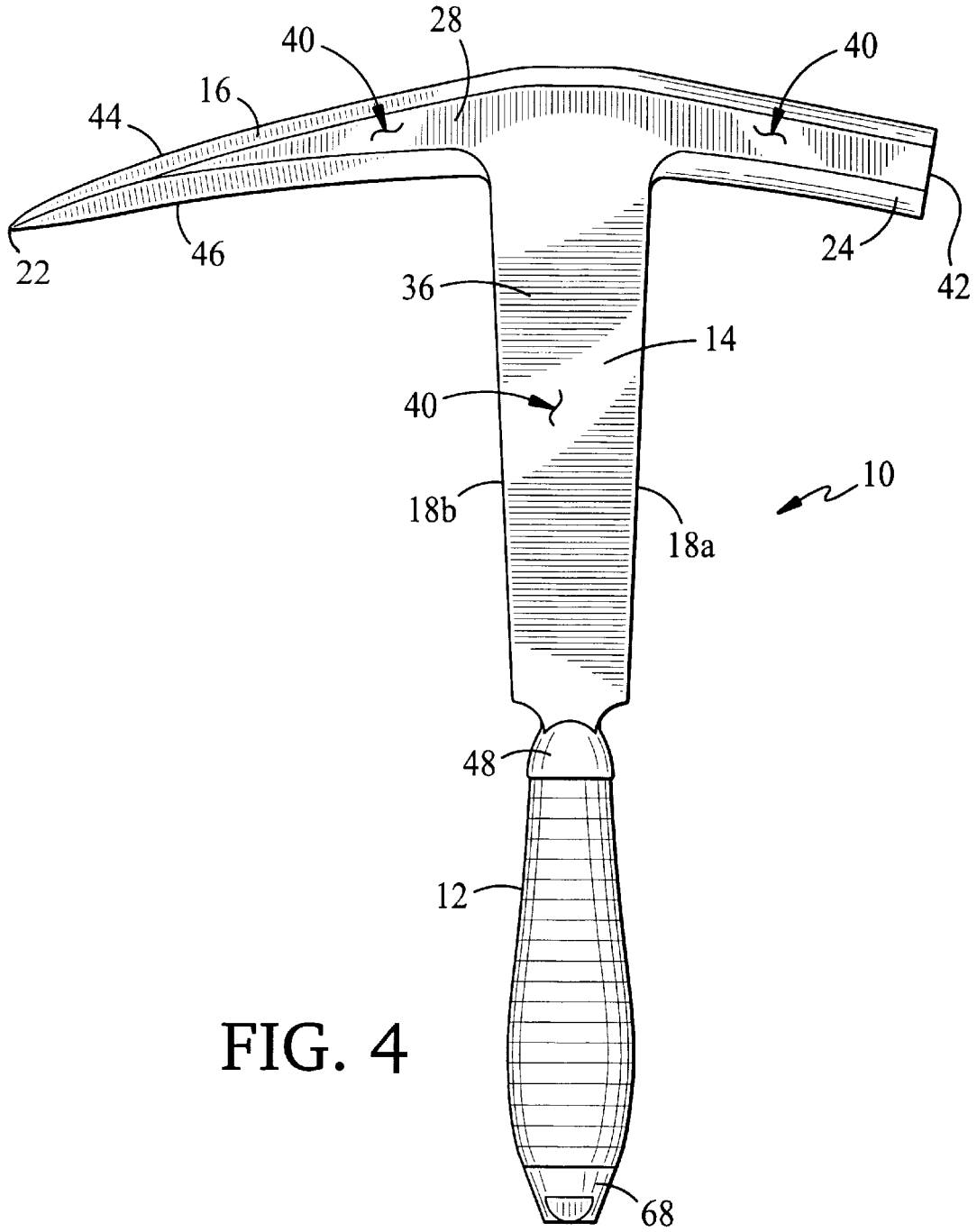
FIG. 4 is a rear view of the hammer.
Figure 5:
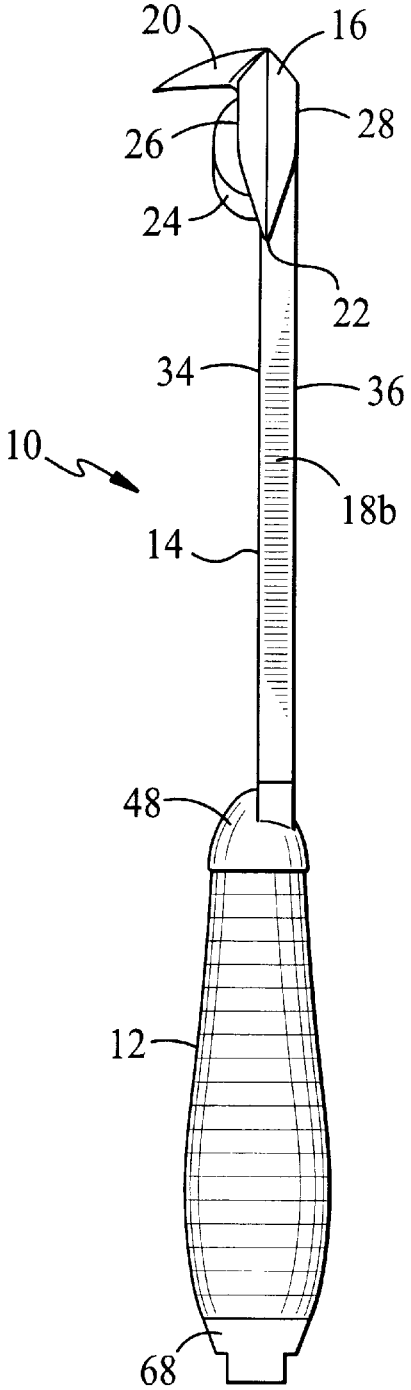
FIGS. 5 and 6 are side views of the hammer.

Referring particularly to FIG. 4, side 28 of cross bar 16 and side 36 of stem body 14 define a continuous flat surface 40 extending from point 22 to end 42 of cross bar 16 and along the length of stem body 14. Side 28 of cross bar 16 tapers to an upper edge 44, a lower edge 46, and to point 22. As shown particularly in FIG. 3, side 26 of cross bar 16 also tapers to upper edge 44, lower edge 36, and point 22.

Figure 6:
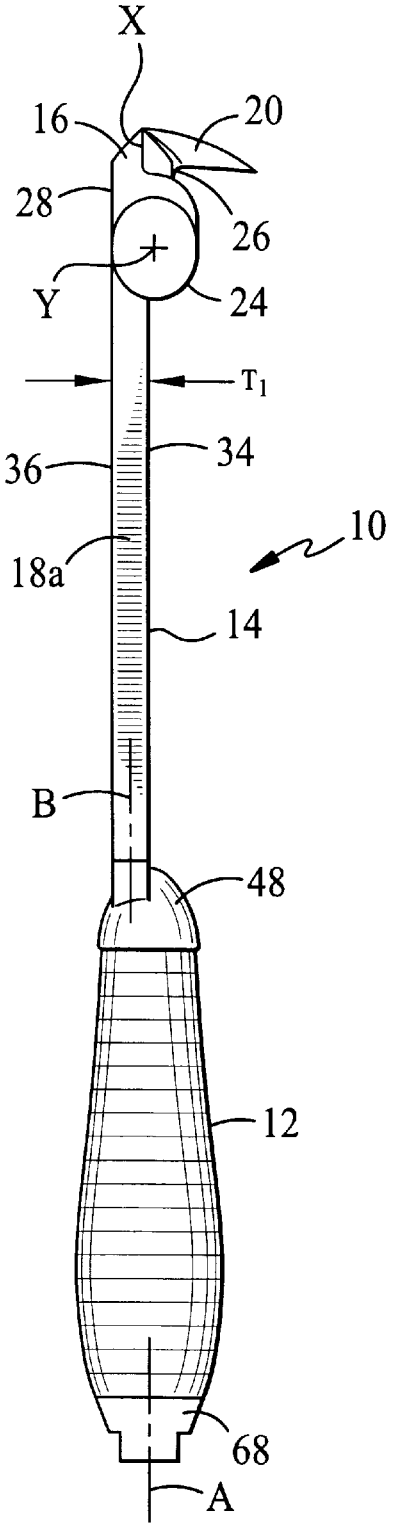
Figure 7:
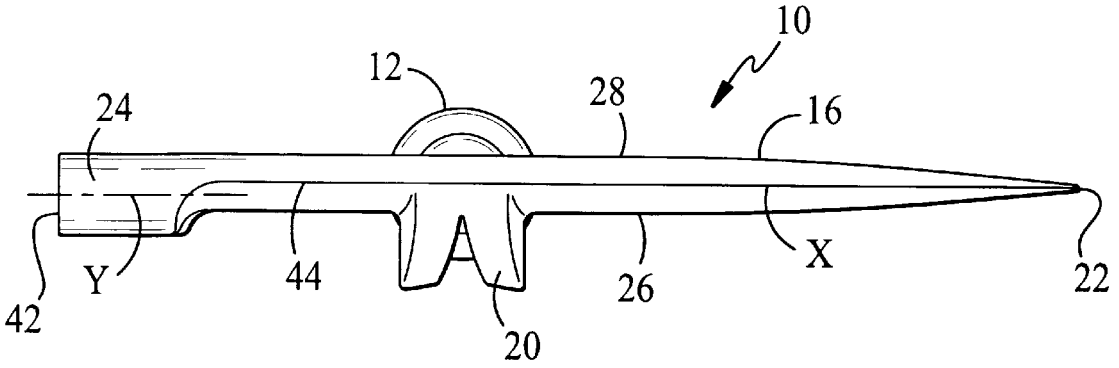
FIG. 7 is a top view of the hammer.
Figure 8:
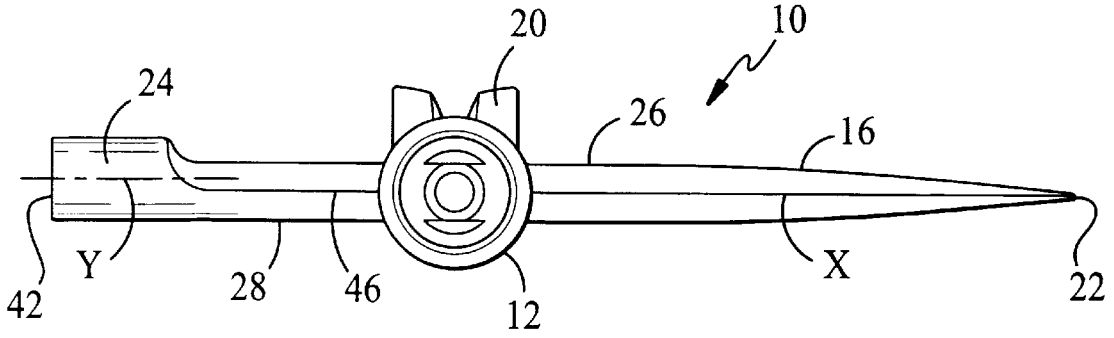
FIG. 8 is a bottom view of the hammer.

Referring to FIGS. 5–8, in order for side 28 of cross bar 16 to be flat along the entire length of the cross bar, from point 22 to end 42, hammer head 24 is positioned with its center, Y, off-axis from the centerline, X, of cross bar 16. As shown in FIG. 6, handle 12 is also offset relative to a centerline B of stem body 14 such that a centerline A of handle 12 is aligned with center, Y, of hammer head 24. This acts to balance hammer 10 when hammer 10 is being used to insert nails. Handle 12 is contoured for easy gripping and stem body 14 is flared at 48 to follow the contour of handle 12.

Figure 9:
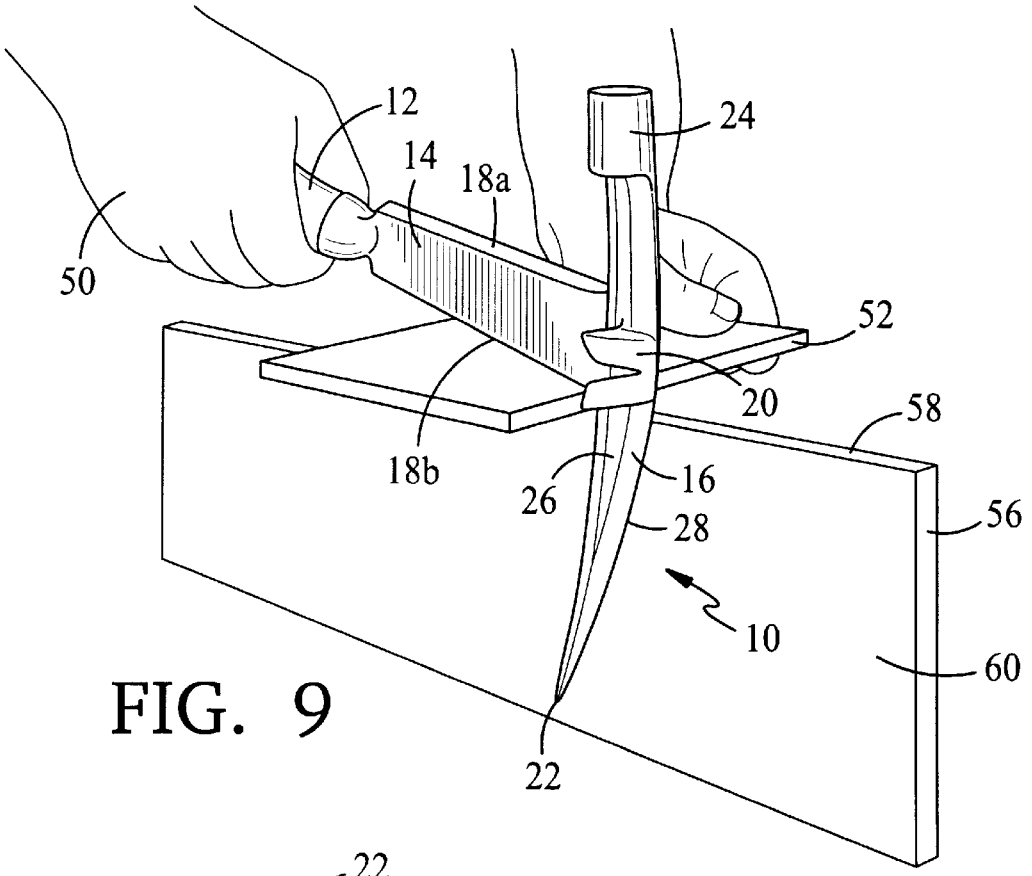
FIG. 9 is a diagrammatic illustration of the hammer being used in a user's right hand to cut slate roofing.
Figure 10:
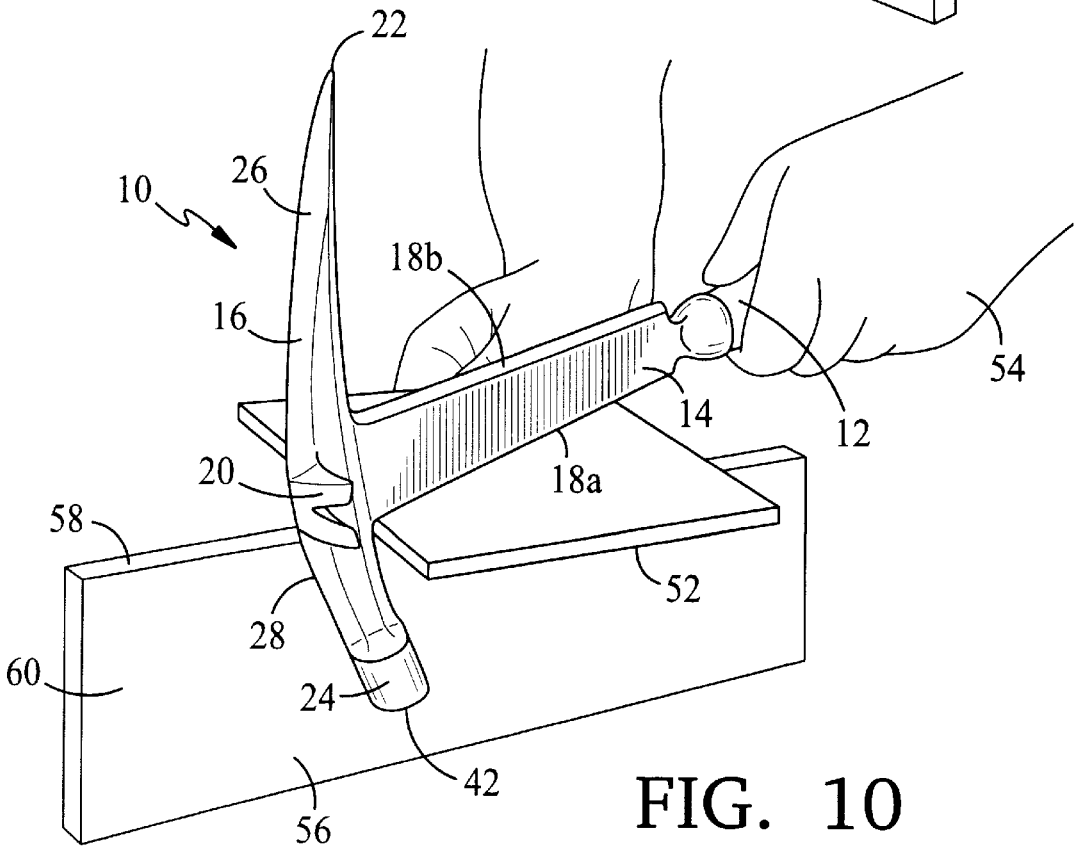
FIG. 10 is a diagrammatic illustration of the hammer being used in a user's left hand to cut slate roofing.

Referring to FIGS. 9 and 10, the combination of the oppositely oriented cutting edges 18*a*, 18*b* and the flat surface 40 extending along the entire length of cross bar 16, permits use of hammer 10 in both a left handed and a right handed action. In FIG. 9, in use hammer 10 is held in a users right hand 50 with cutting edge 18*b* of stem 14 being used to cut slate roofing 52. To stabilize slate roofing 52 and hammer 10 during cutting, slate roofing 52 is held against a top edge 58 of a positioning block 56 and flat surface 40 of side 28 is held against a side 60 of positioning block 56. In FIG. 10, hammer 10 is held in a users left hand 54 with cutting edge 18*a* of stem 14 being used to cut slate roofing 52. Because hammer head 24 is positioned off-axis to form flat surface 40 in the region of end 42, hammer head 24 does not interfere with flat surface 40 being held against block 56.

Figure 11:
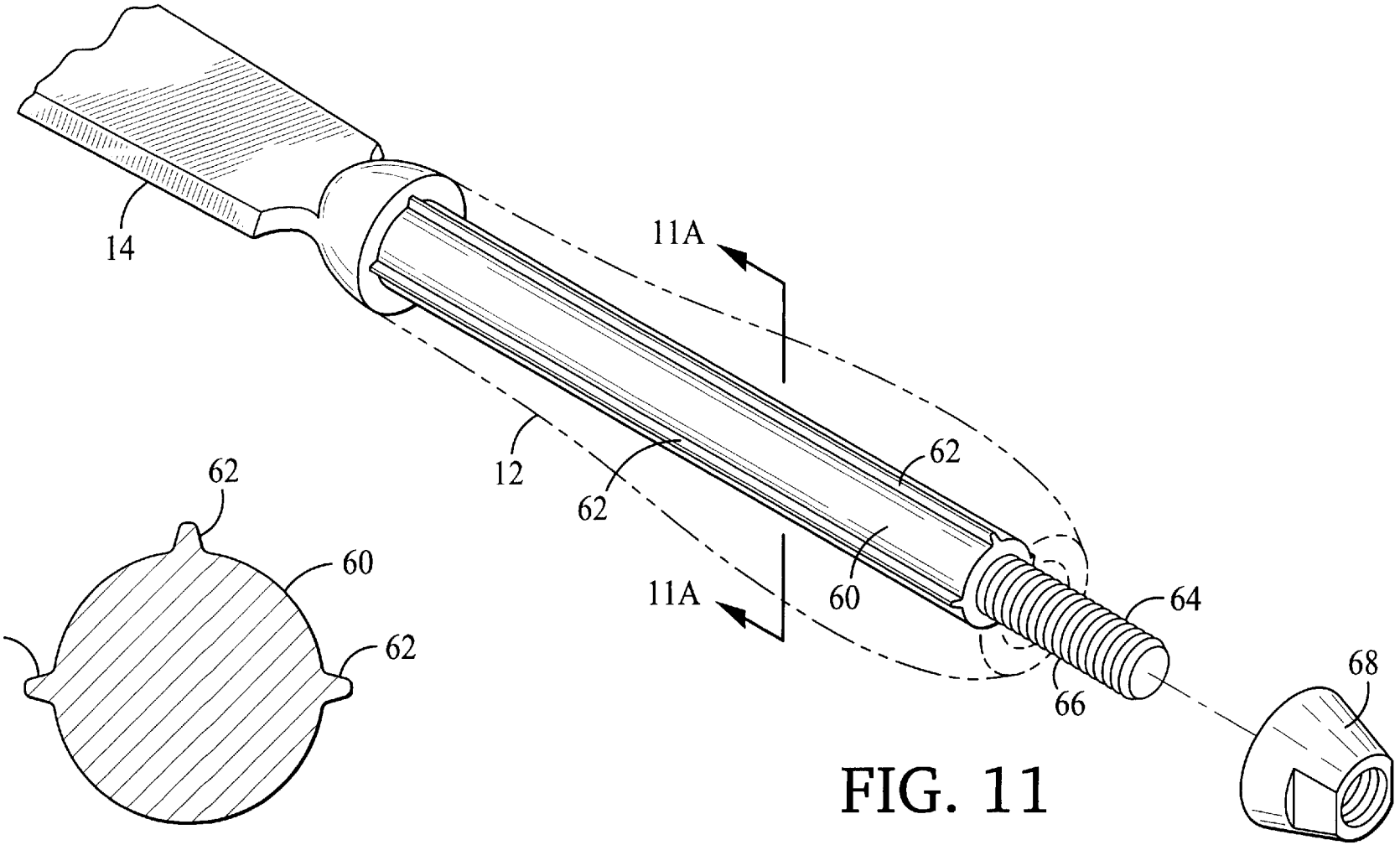
FIG. 11 shows a handle stem of the hammer.
Figure 11A:
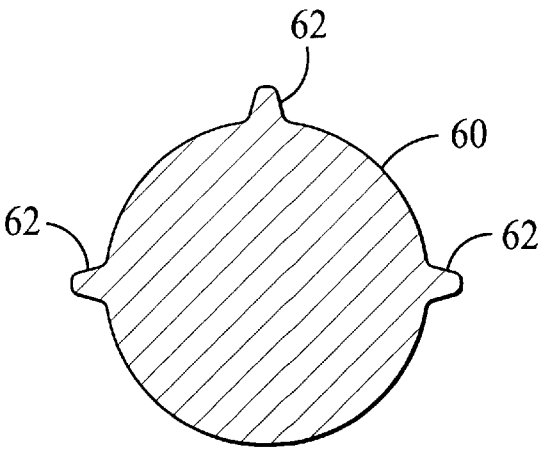
FIG. 11A is a cross-section of the handle stem of FIG. 11, taken along lines 11A–11A.

Referring to FIGS. 11 and 11A, extending from stem body 14 is a handle stem 60 including three splines 62 arranged 90° apart. Handle 12 is formed from leather washers 61 (see FIG. 3) glued together and shaped on a lathe. Handle 12 is then forced onto handle stem 60 with splines 62 forming channels (not shown) in handle 12 during the insertion of handle 12 onto handle stem 60. Splines 62 act to limit rotation of handle 12 relative to stem body 14. Splines 62 are formed in the casting of handle stem 60, stem body 14 and cross bar 12. Threads 64 are machined onto end 66 of handle stem 60, and a brass nut 68 is screwed onto end 66. The outer surface 70 of nut 68 is shaped to follow the contour of handle 12.

Referring again to FIG. 3, hammer 10 has an overall length, $L_1$, of about 11¾ inches, and a width, $W_3$, of about 9½ inches. The length, $L_2$, of handle 12 is about 4 inches. Hammer 10 weighs about 33 ounces and if formed from heat treated ductile iron 80. The ductile iron is normalizing by heating it at a temperature of 1650° F. (±50° F.) for 1 hour, forced air cooled, tempered at a temperature of 900° F.(±50° F.) for 2 hours, and then forced air cooled.

Other embodiments are within the scope of the following claims.

What is claimed is:

1. A hammer, comprising:

a body for cutting having opposed, non-parallel surfaces, and a cross bar attached to the body and having a substantially flat side arranged relative to the surfaces to permit left and right handed cutting.

2. The hammer of claim 1 wherein the body has a substantially flat side continuous with the cross bar substantially flat side.

3. The hammer of claim 1 wherein the cross bar further comprises a hammer head.

4. The hammer of claim 3 wherein the hammer head defines a central axis and the cross bar defines a central axis, the hammer head central axis being positioned off-axis of the cross bar central axis.

5. The hammer of claim 1 wherein the cross bar further comprises a claw.

6. The hammer of claim 1 wherein the cross bar further comprises a pointed end.

7. The hammer of claim 1 further comprising a handle attached to the body.

8. The hammer of claim 7 wherein the handle defines a central axis and the body defines a central axis, the handle central axis being positioned off-axis of the body central axis.

9. The hammer of claim 1 wherein the body further includes a handle stem with a spline for receiving the handle and limiting rotation of the handle relative to the body.

10. The hammer of claim 9 wherein the handle stem includes three splines.

11. A hammer, comprising:

a body for cutting having opposed, non-parallel surfaces, a substantially flat side, and a handle stem with splines, the body defines a central axis, a cross bar attached to the body and having a substantially flat side arranged relative to the surfaces and continuous with the body substantially flat side to permit left and right handed cutting, the cross bar has a central axis and includes a hammer head with a central axis positioned off-axis of the cross bar central axis, the cross bar further includes a claw and a pointed end, and a handle attached to the body, the handle has a central axis positioned off-axis of the body central axis, the handle being received by the handle stem with the splines limiting rotation of the handle relative to the body.

12. The hammer of claim 7 wherein the handle comprises leather.

* * * * *